United States Patent [19]

Hauschildt, deceased

[11] Patent Number: 4,825,183

[45] Date of Patent: Apr. 25, 1989

[54] SWITCH LATCH

[75] Inventor: Herbert Hauschildt, deceased, late of Neumünster, Fed. Rep. of Germany, by Hildegard Hauschildt, heiress

[73] Assignee: Licentia Patent-Verwaltungs GmbH, Frankfurt, Fed. Rep. of Germany

[21] Appl. No.: 849,453

[22] PCT Filed: Jul. 12, 1985

[86] PCT No.: PCT/EP85/00343

§ 371 Date: Mar. 13, 1986

§ 102(e) Date: Mar. 13, 1986

[87] PCT Pub. No.: WO86/00751

PCT Pub. Date: Jan. 30, 1986

[30] Foreign Application Priority Data

Jul. 14, 1984 [DE] Fed. Rep. of Germany ..... 3425996
Oct. 26, 1984 [DE] Fed. Rep. of Germany ..... 3439243

[51] Int. Cl.[4] ..... H01H 9/20
[52] U.S. Cl. ..... 335/167; 335/172
[58] Field of Search ..... 335/172–174, 335/6–10, 167–171, 35

[56] References Cited

U.S. PATENT DOCUMENTS 2,416,170 2/1947 Gano .
2,908,782 10/1959 Kiesel .
2,956,135 10/1960 Feil .
3,194,922 7/1965 Ellsworth ..... 335/9
4,219,713 8/1980 Maier .

FOREIGN PATENT DOCUMENTS 0003967 9/1979 European Pat. Off. .
715937 12/1941 Fed. Rep. of Germany .
921878 5/1954 Fed. Rep. of Germany .
910346 11/1962 Fed. Rep. of Germany .
1178501 9/1964 Fed. Rep. of Germany .
1465274 4/1971 Fed. Rep. of Germany .
2831135 11/1979 Fed. Rep. of Germany .

*Primary Examiner*—E. A. Goldberg
*Assistant Examiner*—Lincoln Donovan
*Attorney, Agent, or Firm*—Spencer & Frank

[57] ABSTRACT

A switch latch for a power switch including a supporting part of the type having two planar, parallel connected bearing plates, a switching mechanism adapted to hold a lock mechanism, wherein the levers of the switch latch are configured as planar members, simple pins are used as bearing pins and as connecting pins, and simple tension springs serve as spring elements, wherein one side of each bearing plate projects to form an assembling tab which projects at right angles to another portion of the respective bearing plate, and the bearing plates are connected with one another by an assembling bracket connected at the side opposite the tab ends, with the assembling bracket being configured as a planar member. The bearing plates are releasably connected with the assembling bracket, and the assembling bracket has openings for the latching engagement of other projections which are disposed on each respective bearing plate opposite the tab ends and has at least one bore for receiving a fastening screw for the purpose of fastening the lock mechanism to a switching instrument housing.

24 Claims, 7 Drawing Sheets

10
11
30
48
32a
28
47
38
32b
18
45
32
59
26c
33
36
39
31
27
17
37
21
15
14

30
10
11
48
47
38
32b
28
18
45
32
36
33
26
39
21
31
50
17
27
37
15
14

SWITCH LATCH

BACKGROUND OF THE INVENTION

The invention relates to a switch latch for a switchgear having a supporting part that has two flat, parallel bearing plates joined by an assembling bracket, and is adapted for holding a latch mechanism. A switch latch of this type is known for instance from German Patent No. 921 878. The known structure shows a small automatic switch in the form of a mounting, with jacks supporting the switch mechanism. The jacks are retained in slits of the mounting via projections that are provided with recesses. German Patent No. 715 937 discloses a switch latch for a switchgear having two bearing plates, extending parallel to one another, for holding parts of the switch latch. The bearing plates have assembling tabs and are joined together by means of an assembling bracket to form a structural unit that is ready to be assembled. From German examined patent application DE-AS 11 78 501, a switch latch for a switch gear is known in which the bearing plates used to hold switch latch parts are kept spaced apart by offset spacer bolts. This switch latch is mounted in housing recesses and is secured against sliding crosswise by housing parts resting laterally on it. A structure similar to the above types is also disclosed by U.S. Pat. No. 4,123,734. The following references show further types known in this field: German examined application DE-AS 28 31 135, Swiss Patent No. 409 079, and British Patent No. 926,792.

SUMMARY OF THE INVENTION

It is the object of the invention to embody a switch latch of the above type such that it is easier to assemble, thereby simplifying switchgear manufacture. This object is attained by means of the novel switch latch for a power switch according to the present invention.

Embodying the switch latch according to the invention enables automated assembly, because the switch latch is manufactured as a ready-to-assemble structural unit that can easily be built into a switchgear housing. The switch latch can be built into the housing automatically, for instance by inserting the switch latch, with its assembling tabs that project at right angles, into prepared, matching housing recesses and securing it via an assembling bracket to elements integral with the housing, using securing means such as screws. The switch latch is thereby secured in the housing via three securing points: via the two tab ends that are inserted into matching openings in the housing, and via the securing means on the assembling bracket. These three securing points are located in approximately the same securing plane. The two bearing plates, disposed like offstanding lugs and between them receiving all the parts of the switch latch, extend at right angles to this securing plane. Since the securing means of the switch latch are disposed on only one end, the off-standing lug-like bearing plates can be fully exploited for receiving the switch latch parts, without having securing means for the switch latch in the way. A switch latch that is built into electric switchgear in this manner is integrated with a pole path. The present invention is preferably applicable to heavy-duty electric switches.

Because the supporting parts of the switch latch and the levers of the switch mechanism are embodied as flat parts and furthermore only simple bolts and tension springs are used for the switch latch, automated manufacture of the switch latch becomes possible, because such parts are easily stored. The switch latch is advantageously well suited for automated assembly, because the switch latch that is inserted into the housing openings intended for the assembling tabs needs to be fixed at only one point, in the vicinity of the assembling bracket, by means of a screw or the like.

As the invention is embodied, the bearing plates serve as stationary pivot bearings for an operating lever and a ratchet lever; the operating lever is joined via at least one tension spring to the pivot bolt of a toggle lever, one arm of which is articulated on the ratchet lever and the other arm of which is embodied for actuating a movable contact piece of the switchgear. The result is a simple structural unit having two pivot bearings for the operating lever, on the one hand, and the ratchet lever on the other, the toggle lever being articulated with its one free lever arm on the ratchet lever. The operating lever, ratchet lever and toggle lever are thus located in different, parallel planes of motion inside the two bearing plates, which extend parallel to the planes of motion.

To facilitate assembly and manufacture of the individual parts of the switch latch itself, the bearing plates, the assembling bracket, the operating lever, the ratchet lever and the toggle lever are all embodied as flat parts. This has the advantage that they can be manufactured by stamping, for example, can be stacked in a simple manner and without requiring a large amount of space, and can be easily stored and are thus suitable for automated manufacture of the switch latch. Automated manufacture is impossible, or virtually impossible, for instance, if the switch latch parts are bent or crimped at right angles or have interpenetrating portions. For this kind of automated manufacture, the bearing plates are joined to the assembling bracket by a snap fit. The assembling bracket has openings in which projections of the bearing plates snap into locking engagement and is provided with bores for receiving screws so as to secure the unit in a switchgear housing. The basic structure of the frame for the switch latch is thus made by simply snapping together the two bearing plates and the crosswise assembling bracket. This connection may be releasable, or it may be fixed, for example by riveting. The result is a structure with lug-like offstanding assembly plates between which the above-mentioned switch latch parts can be disposed in a simple manner and without being hindered by securing means. Further advantageous embodiments will become apparent from the dependent claims and the description.

BRIEF DESCRIPTION OF THE DRAWINGS

In the drawings, FIGS. 1–4 each show side sectional views of a switchgear having a switch latch according to the invention, with various switching positions being shown. FIG. 5 is a plan view on the switchgear of FIGS. 1–4. FIG. 6 shows a detail. FIGS. *7a, b* and *c* show three views of the switch latch.

DETAILED DESCRIPTION OF THE PREFERRED EMBODIMENTS

Figure 1:
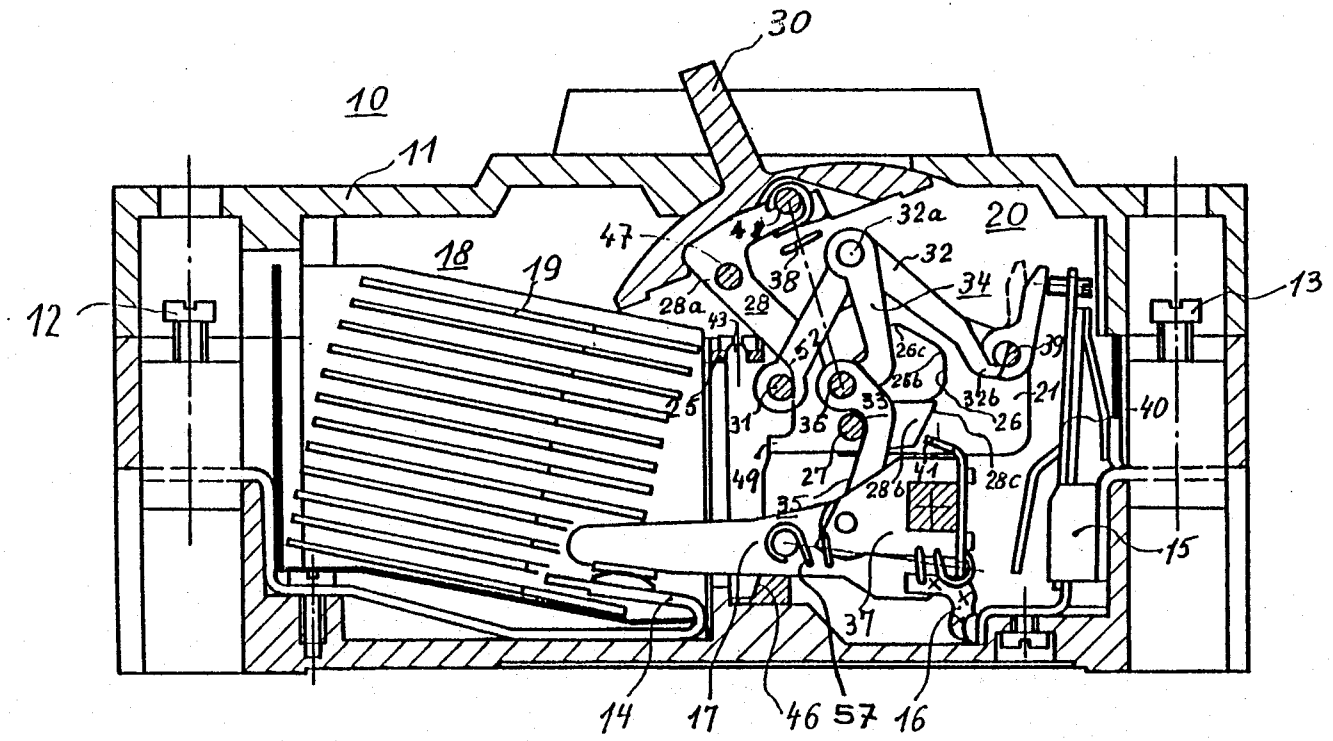
FIGS. 1–7 show an exemplary embodiment of the subject of the invention.

FIGS. 1–4 show a heavy-duty switch 10 having a plastic housing 11. The heavy-duty switch has three pole paths, only one of which is visible in FIGS. 1–4. The housing 11 has three connection terminals 12 and three connection terminals 13 on its respective ends for the lead-in and lead-out wires. The connection terminals 12 are connected to a fixed contact piece 14, and the connection terminals 13 are connected via a tripping unit 15 and a flexible line 16 to a movable contact piece 17. Reference numeral 18 indicates a stack of quenching plates comprising a plurality of individual quenching plates 19. A switch latch is used to actuate the movable contact piece 17. The switch latch 20 has two bearing plates 21, 22 extending parallel to one another and made from flat stamping parts; only the rear bearing plate 21 is visible in FIGS. 1–4. The two bearing plates 21, 22 each have an assembling tab 23, 24 chamfered at the end and are releasably joined to one another by an assembling bracket 25. The bearing plates 21, 22 each have a recess 26 that has indentations 26*a, b, c* to be described below.

An operating lever is supported between the bearing plates 21, 22 via a bearing bolt, being embodied as a double lever comprising two spaced-apart flat stamping parts 28, 29. The stamping parts 28, 29 form a two-armed pivot lever with one long lever arm 28*a*, 29*a* and one short lever arm 28*b*, 29*b*. At the end of the long lever arm 28*a*, 29*a*, a toggle 30 for actuating the switch latch is provided. The parts 28, 29 are joined by the bolts 27 and 47, 48 (see below).

A flat stamped ratchet lever 32 is supported between the bearing plates 21, 22 via a further bearing bolt 31. The ratchet lever 32 is embodied as a single-armed bell crank. The latch 20 finally has a toggle lever 33 having a lever arm 34 and a lever arm 35, which are joined to one another by a pivot bolt 36. The lever arms 34, 35 are each embodied as double lever arms 34*a, b* and 35*a, b*. One double-armed lever arm 34*a, b* is articulated in the vicinity of the bend of the bell crank 32 via a pivot bolt 32*a*. The double-armed lever arm 35*a, b* is articulated on a control shaft 37, which in turn carries the movable contact pieces 17. Two tension springs 38 are mounted between the pivot bolt 36 and the upper operating lever.

Figure 2:
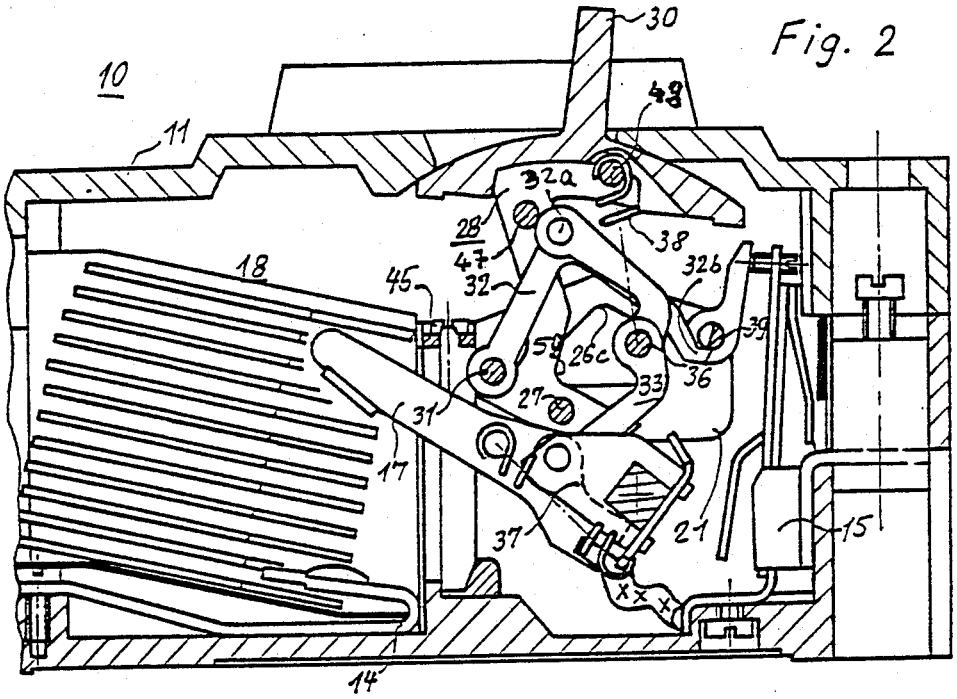
Figure 3:
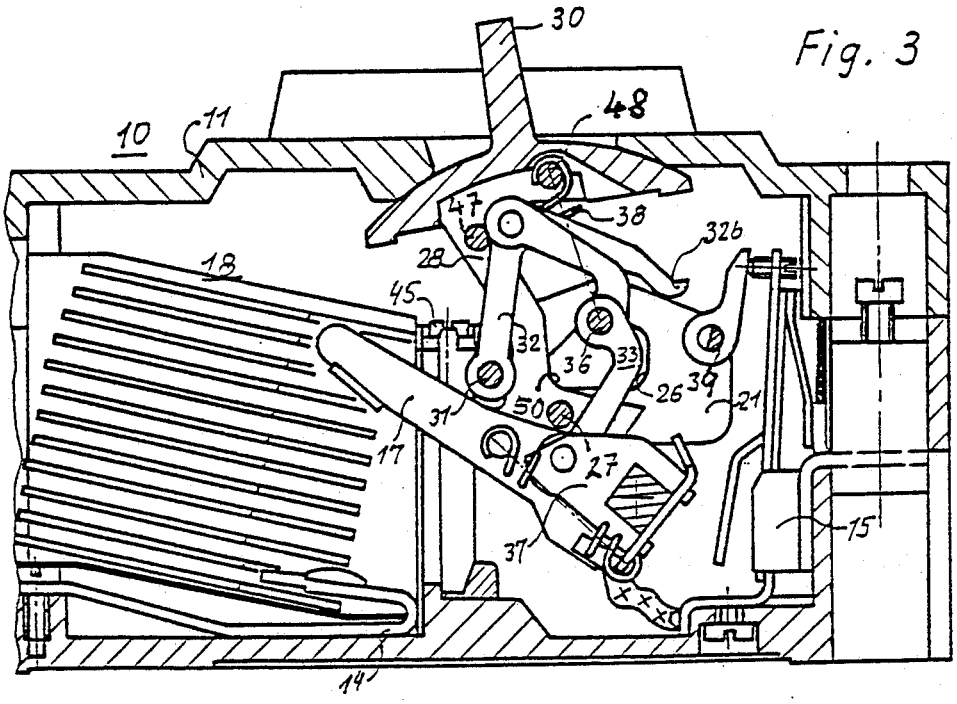

FIG. 1 shows the switch in its ON state, that is, with closed contacts 14, 17. The switch latch 20 is latch-locked; that is, the ratchet lever 32 rests with a protrusion 32*b* on a half-shaft 39, which can be rotated by bimetallic elements 40, for instance, in the event of a current overload. In this position, the bearing bolt 36 of the toggle lever 33 is located in an indentation 26*a* of the recess 26. FIG. 2 shows a position in which the switch 10 has been turned OFF manually, and the tripping device 15 has not responded; that is, the latch locking between the ratchet lever 32 and the half-shaft 39 has not been released. The pivot bolt 36 is now located in a different indentation 26*b* of the recess 26. The toggle 30 is in the OFF position shown. In FIG. 3, the contacts 14, 17 have been opened by the response of the tripping device 15, because the bimetallic elements 40 have bent outward and released the latch-locking engagement between the ratchet lever 32 and the half-shaft 39. The pivot bolt 36 of the toggle lever 33 is now located in an indentation 26*c* of the recess 30. The toggle 30 is in a middle position. The tension springs 38 each skip over the dead center position.

Figure 4:
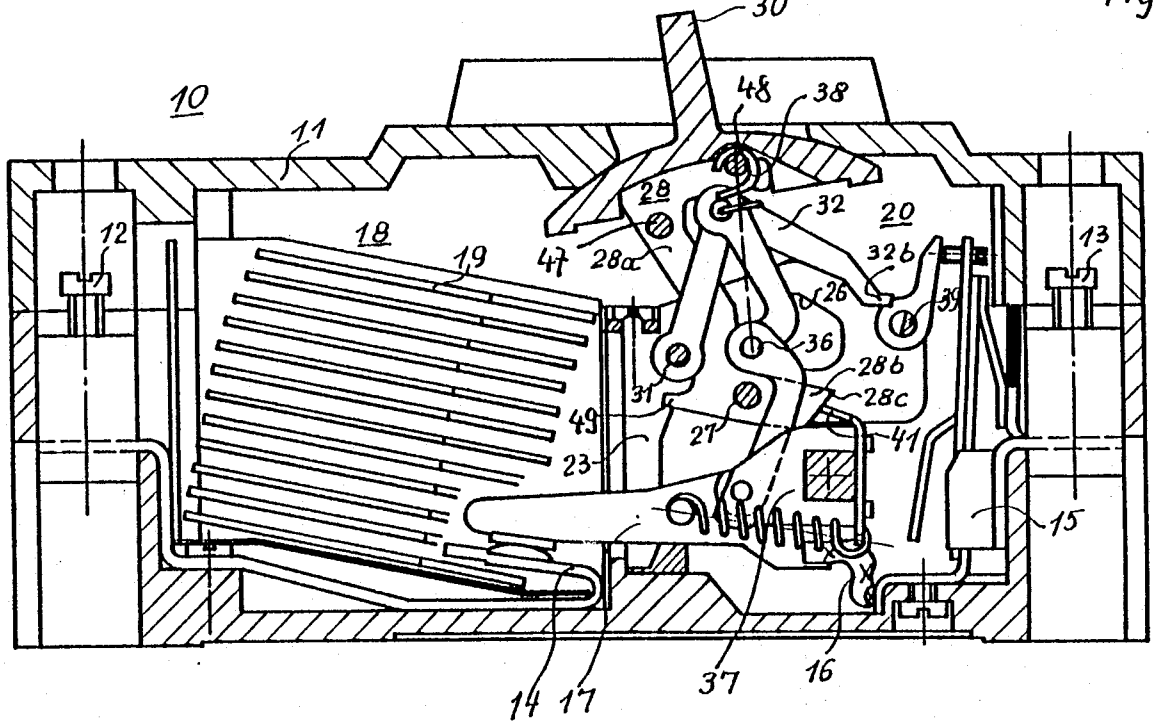
Figure 5:
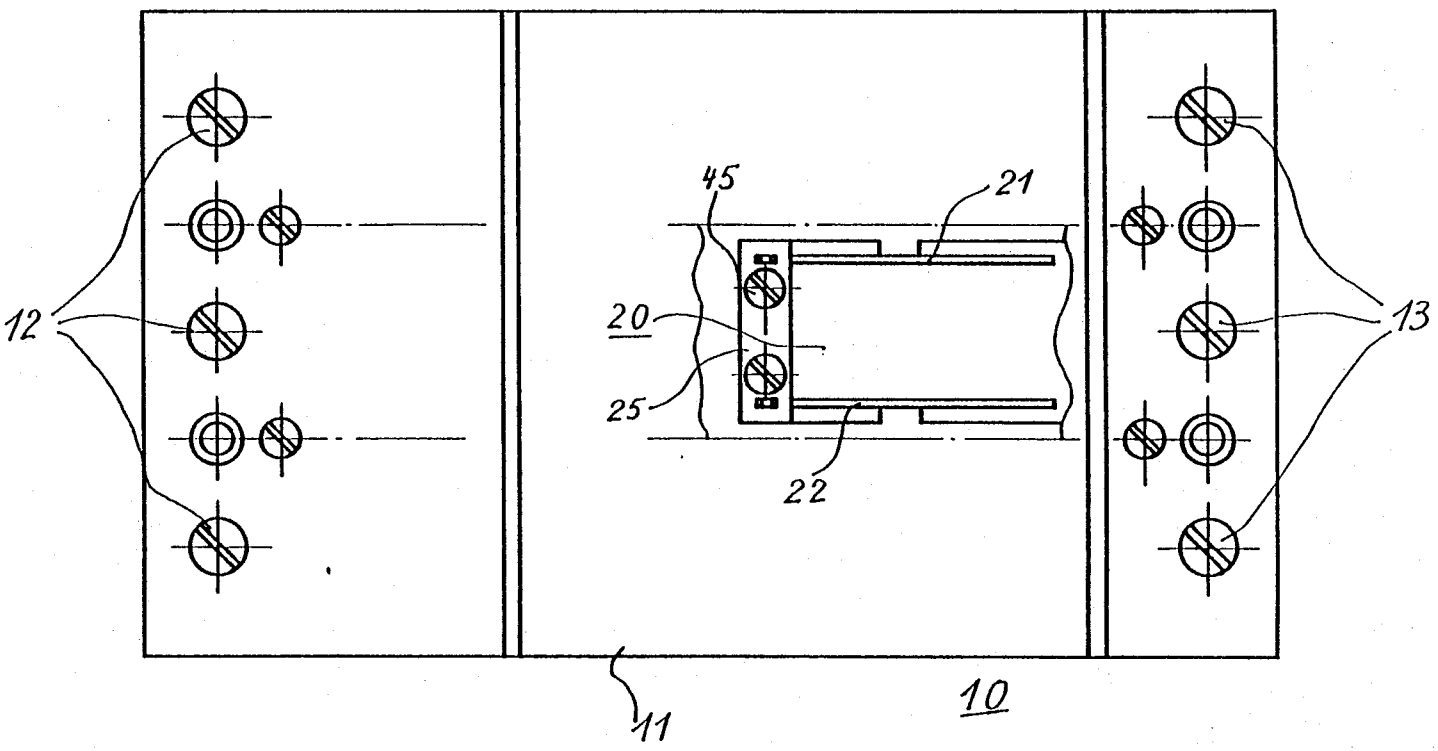
Figure 6:
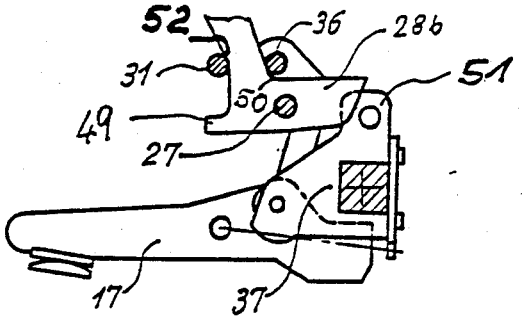

From FIG. 4 it is apparent that the short lever arm 28*b*, 29*b* of the operating lever 28, 29 is chamfered and is disposed facing a projection 41 of the control shaft. This arrangement serves to interrupt the contacts 14, 17 mechanically, in the event that they are welded together and cannot be separated even through the toggle 30 has been moved toward the OFF position shown in FIG. 2. This kind of welded condition is shown in FIG. 4. Here the tripping device 15 has responded, so that the latching engagement of 32*b* and 39 is released. Since the contacts 14, 17 are welded, they have not been able to separate from one another. The toggle 30 is in the position shown, and the oblique face 28*c* rests on the projection 41. If the toggle 30 is moved farther toward the OFF position in this case, then the operating lever 28, 29 exerts a torque upon the control shaft 37 that acts in the direction of opening the movable contact 17. FIG. 6 shows a different embodiment, in which an integrally formed extension 51 of the control shaft 37 serves as the projection of this control shaft.

Figure 7A:
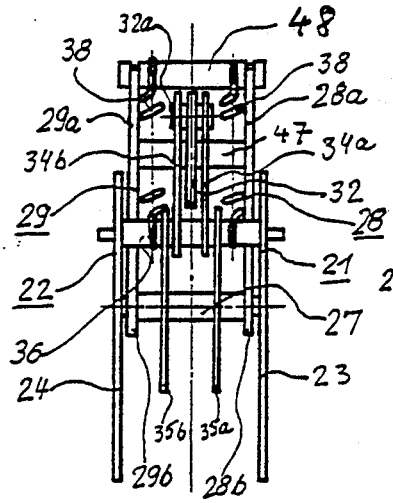
Figure 7B:
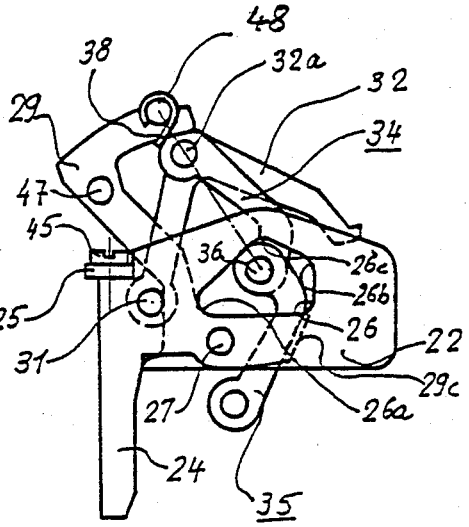
Figure 7C:
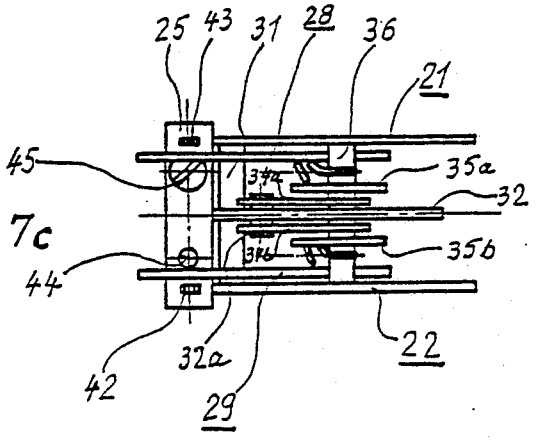

The assembling bracket 25 shown in FIG. 7 has openings 42 on its ends for receiving projections 43 of the bearing plates 21, 22. The assembling bracket 25 also has at least one bore 44 for receiving a securing screw 45. For securing the switch latch 20, the latch is inserted with its assembling tabs 23, 24 into housing recesses 46 and then screwed onto the housing in a stationary position via the securing screw 45.

Because of the flat embodiment of the bearing plates, the assembling bracket, the parts of the operating lever, the ratchet lever and the toggle lever and because simple bolts are used as bearing bolts and connecting bolts, automated assembly becomes possible, because these parts can easily be stacked and stored. The switch latch assembled from individual parts forms a ready-to-assemble structural unit, which can be inserted manually or automatically with its assembling tabs into the prepared housing recesses 46 and then fixed by screws 45 via the assembling bracket 25. The housing 11 may be embodied such that the lug-like offstanding parts of the bearing plates are secured against sliding crosswise by means of protruding portions of the housing.

The switch latch 20 itself is assembled such that the bearing plates 21, 22 are joined to one another by means of the bracket 25 that is snapped onto them. If needed, the bracket 25 may be fixed to the bearing plates 21, 22 by riveting the parts 43. The ratchet lever 32 is mounted in the bearing plates 21, 22 via its bearing bolt 31 having shouldered ends. By providing the shoulders on the bearing bolt, the bearing plates are kept spaced apart by a specific desired distance. The shouldered ends of the bearing bolt that pass through the bearing plates may be riveted if needed. The two parts 28, 29 of the operating lever are likewise joined to one another by a shouldered bearing bolt 27, which keeps the parts 28, 29 spaced apart by a fixed mutual distance. The shouldered ends of the bearing bolt 27 pass through both the parts 28, 29 and the bearing plates 21, 22 at bearing openings providing therefor. Here again, the ends of the bearing bolt 27 may be flanged over or riveted, as needed. For the sake of stability, a separate spacer bolt may be provided, again flanged over on its end if needed, at the end of the lug-like offstanding parts of the bearing plates.

The spring 38 engage the pivot bolt 36 at one end and a spring bolt 48 at the other; the spring bolt 48 is simply placed in semicircular recesses on the outside of the operating lever 28, 29. The spring bolt 48 and pivot bolt 36 may be embodied identically. The suspended springs 38 impart great stability to the system comprising the operating lever 28, 29, the toggle lever 33 and the ratchet lever 32. The spring bolt 48 is provided with constrictions for the engagement of the springs 38 and for retention in the semicircular recesses.

Reference numeral 47 indicates a carrier bolt, which may also be embodied as a shouldered spacer bolt. It serves to exert mechanical action upon the ratchet lever 32 in the vicinity of the pivot bolt 32*a* to effect switching ON again after tripping. To this end, for resumption of latched engagement the operating lever 28, 29 is moved toward the right and in so doing the carrier bolt 47 carries the ratchet lever 32 along with it until its protrusion 32*b* locks into place again at 39. Subsequently, by moving the operating lever 28, 29 toward the left, the movable contacts 17 switch ON. This occurs because the toggle lever 33 skips over its dead center position and effects abrupt actuation.

The operating lever 28, 29 is embodied such that the bearing bolt 31, both in the ON position shown in FIG. 1 and the OFF position shown in FIG. 2, acts as a limitation for the movement of the lever 28, 29; see the recessed contours 52 and the lug-like projections 49.

The pivot shaft 36 of the toggle lever 33 may be guided in the recess 26 as in the exemplary embodiment of FIG. 1. However, under some circumstances this can cause undesirable friction losses. This kind of guidance of the pivot bolt 36 in the recess 26 is not required for the functioning of the latch. The recessed contour 50 of the operating lever 28, 29 can also serve as a stop for the bolt 36 in the ON position. Nor is a stop on the parts 26*b*, 26*c* necessary for the pivot bolt 36 in the OFF or tripped position. In these positions, the movable contact lever 17 is already resting on the stationary bearing bolt 27. Thus the maximal movement of the pivot bolt 36, which is joined to the movable contact 17 via the levers 35, is already limited.

The function of the carrier bolt 47 can also be attained by means of the mounted toggle 30, by providing the inside of the toggle with a corresponding projection intended for acting upon the ratchet lever 32. The toggle 30 may also be provided on its inside with corresponding grooves for mounting it on the parts 28, 29. This particularly simple manner of mounting the toggle 30 also has a stabilizing effect on the double lever comprising the two parts 28, 29.

By means of the releasable connection between the switch latch and the control shaft according to the invention, it is possible to assemble the control shaft, with the movable contacts and the bimetallic elements possibly connected thereto, on the one hand, and the latch, on the other, separately from one another. In that case the control shaft is first assembled in the lower part of the housing along with the movable contacts and the bimetallic bands, and then the completely pre-assembled switch latch can be coupled to the control shaft by means of a simple snap fit, via the free end of the lever arm that is provided with a slot. The separate assembly of the two structural units means that assembly is simplified, and the assembly of both units from only one assembly direction becomes possible, thus enabling automated assembly.

Figure 8:
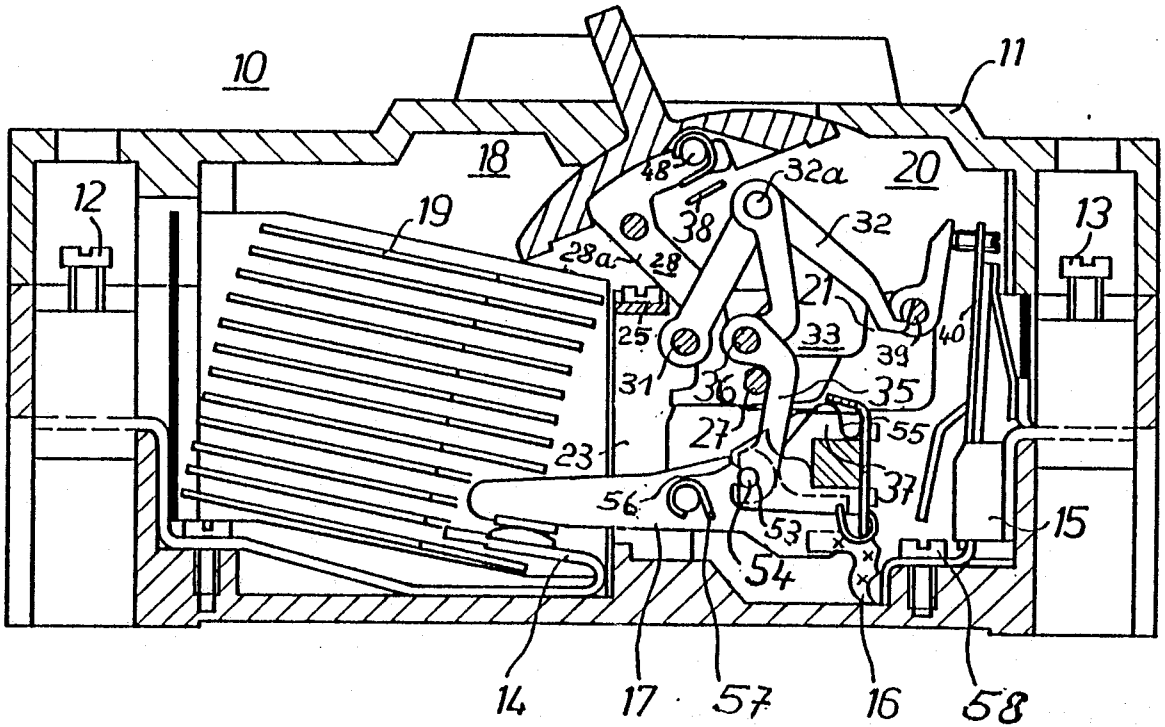
Figure 9:
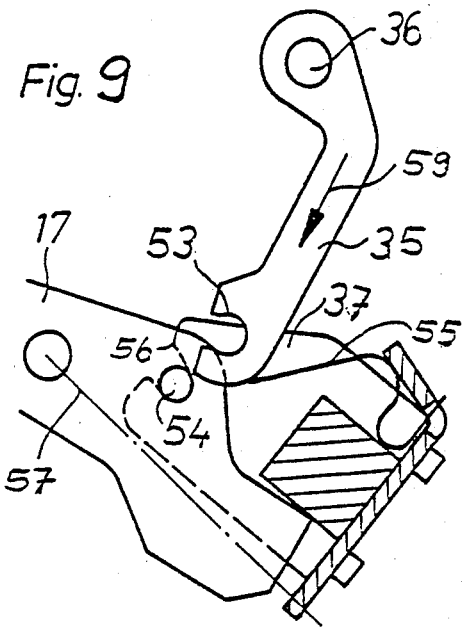
Figure 10:
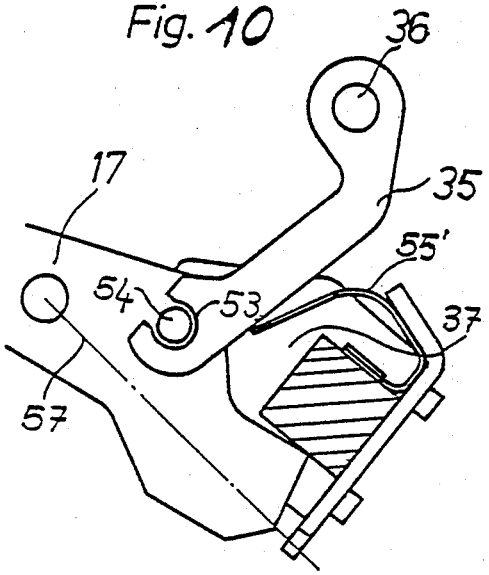

FIG. 8 is a longitudinal section taken through a heavy-duty switch, in which the switch latch 20 and the control shaft 37 are releasably coupled together. FIGS. 9 and 10 show two associated steps in assembly intended for making this connection, each showing details on a larger scale of what was shown in FIG. 8. Otherwise FIG. 8 corresponds substantially to FIG. 1, except that the bearing plates 21 in this exemplary embodiment have recesses that are open at the top and also do not have any well-defined indentations as in FIG. 1.

The free end of the lever arm 35 has an open slot 53, which is undercut. With the slot 53, the lever arm 35 is slipped onto a coupling bolt 54 of the control shaft 37. A leaf spring 55 is shown, which in the finally assembled state of the lever arm 35 presses against the coupling bolt 54 and thus effects a tensional connection between the control shaft 37 on the one hand and the lever arm 35 or switch larch 20 on the other. The coupling bolt 54 is firmly mounted on the movable contact piece 17 and serves to support this movable contact piece 17 in a similarly simple manner in a slot 56 of the control shaft 37. In the inserted state, the movable contact piece 17 is pressed against the bottom of the open slot 56 by tension springs 57, which simultaneously act as contacting force springs. The result is a contact system that opens electrodynamically. The releasable connection between the switch latch 20 and the control shaft 37 now makes it possible to assemble the bimetallic elements 40 joined to the control shaft 37 from the inside, via the securing screws 58 which are now readily accessible. As a result, only a single assembly direction is needed, thus offering the opportunity of automated assembly. The assembly/insertion direction for the lever arm 35 is indicated as 59. In FIG. 10, the leaf spring 55' has a shape somewhat different from that in FIG. 9. Here too, the front part of the control shaft 37 that is visible in FIG. 8 and has a slot 56 for the bolt 54 is not shown, for the sake of simplicity.

I claim:

1. A switch latch for a power switch of the type having including a supporting part which includes two planar, parallel connected bearing plates holding a lock mechanism which includes a plurality of levers which are sheet-like members, a plurality of bearing pins, a plurality of connecting pins, and a plurality of tension springs which serve as spring elements, the improvement comprising:

an assembling bracket;

each bearing plate having an assembling tab which projects at approximately a right angle to a main body portion of the respective bearing plate, each said assembling tab having a tab end and projecting end opposite said tab end, said assembling bracket connecting said bearing plates together at the side opposite said tab ends, said assembling bracket being a generally sheet-like member, said bearing plates being releasably connected with said assembling bracket, said assembling bracket having a plurality of openings for receiving said projecting ends of said bearing plates, said asembling bracket having at least one bore for receiving a fastening member for fastening said lock mechanism to a switching instrument housing.

2. A switch latch as defined by claim 1, wherein said bearing plates form stationary pivot bearings for an operating lever and a ratchet lever, and said operating lever (28, 29) is joined via at least one tension spring to a pivot bolt of a toggle lever having two levers arms, one lever arm of which is articulated on said ratchet lever and the other lever arm of which is adapted for actuating a movable contact piece of the lock mechanism.

3. A switch latch as defined by claim 1, wherein the sheet-like parts are manufactured by stamping.

4. A switch latch as defined by claim 2, further comprising bearing bolts for forming the pivot bearing of said operating lever and of said ratchet lever, the ends of each of said bearing bolts being each supported in bores of said bearing plates.

5. A switch latch as defined by claim 1, wherein said bearing plates are kept spaced apart from one another by shouldered spacer bolts.

6. A switch latch as defined by claim 4, wherein at least one of the bearing bolt of said operating lever and the bearing bolt of said ratchet lever serve as spacer bolts.

7. A switch latch as defined by claim 5, further comprising a plurality of separate spacer bolts.

8. A switch latch as defined by claim 2, wherein said operating lever is a double lever, has a pivot point, and has two parts joined together, said two parts being adjacent to said bearing plates, and two tension springs in engagement with an end of said double lever remote from said pivot point, said end of said double lever having a toggle lever.

9. A switch latch as defined by claim 2, wherein said operating lever is a two-armed pivot lever having one short lever arm (28*b*, 29*b*) and one long lever arm (28*a*, 29*a*), and said at least one tension spring engages the end of said long lever arm said toggle lever.

10. A switch latch as defined by claim 2, wherein said ratchet lever is embodied as a single-armed bell crank, the free end of which is embodied for cooperation with a tripping catch of said switchgear, and that said pivot point for the one toggle lever arm 34 is located in the vicinity of the bend of the lever.

11. A switch latch as defined by claim 2, wherein said operating lever has a carrier bolt for exerting action upon said ratchet lever and a spring bolt for articulating said at least one tension spring.

12. A switch latch as defined by claim 4, wherein said bolts are flanges over at their protruding ends which project outside said bearing plates.

13. A switch latch as defined by claim 11, wherein said spring bolt is disposed in semicircular recesses on the outside of said operating lever, said spring bolt has corresponding annular grooves.

14. A switch latch as defined by claim 1, wherein said operating lever, on its outside, in the vicinity of said bearing bolts for said ratchet lever, has lug-like projections and outer recessed contours and opposite these on the inside of said operating lever, near said bearing bolt, said operating lever has inner recessed contours.

15. A switch latch as defined by claim 2, wherein said pivot bolt connecting said two lever arms of said toggle lever is slidingly guided on its two ends in recesses of matching shape of said bearing plates.

16. A switch latch as defined by claim 15, wherein said recesses have indentations for the latching reception of the ends of said pivot bolt.

17. A switch latch as defned by claim 1, in combination with a pole path of a switchgear, wherein said lock mechanism is in locking engagement, each said assembling tab being disposed in accurately matched recesses of a switchgear housing, said assembling tabs being secure to a portion of said housing in the vicinity of said assembling bracket by securing means which are secured against transverse sliding by housing parts resting laterally thereon, and is coupled via a toggle lever to a movable contact piece.

18. A switch latch as defined by claim 17, wherein said bearing plates form stationary pivot bearings for an operating lever and a ratchet lever, and said operating lever is joined via at least one tension spring to a pivot bolt of a toggle lever having two lever arms, wherein said pivot bolt connecting said two lever arms of said toggle lever is slidingly guided on its two ends in recesses of matching shape of said bearing plates, and wherein one toggle lever arm is articulate on a control shaft of said switchgear and a ratchet lever is disposed for latching engagement with a tripping device of said switchgear, wherein each recess has two indentations, which serve to limit the motion of said pivot bolt for ON and OFF positions, and a further indentation which, when said ratchet lever is unlatched, serves to limit the motion of said pivot bolt in the tripped position.

19. A switch latch as defined by claim 9, wherein said two-armed operating lever has a chamfered face provided on said short lever arm, which face cooperates with a projection of a control shaft to provide opening of a movable contact piece in the event of the contacts being welded together, and upon movement of said operating lever in to the OFF position.

20. A switch latch as defined by claim 19, wherein said projection is an integrally molded extension of said control shaft.

21. A switch latch for a switchgear as defined by claim 18, wherein said free end of said other lever arm has a slot which receives a coupling bolt of said control shaft and is held in a tensionally connected manner in an engagement position by a resilient element.

22. A switch latch as defined by claim 21, wherein said slot of said lever arm has an undercut.

23. A switch latch as defined by claim 21, wherein said resilient element is a leaf spring, which deflects upon insertion of said lever arm such that, once a connection is established between said lever arm and the control shaft, said leaf spring presses said lever arm against said coupling bolt.

24. A switch latch as defined by claim 21, wherein said coupling bolt. is a bolt with which a movable contact piece of said switchgear is inserted into an open groove of said control shaft and is prevented from falling out by a tension spring.

* * * * *